US005980185A

United States Patent [19]

Vita

[11] Patent Number: 5,980,185

[45] Date of Patent: Nov. 9, 1999

[54] VEHICLE PARKING STRUCTURE

[75] Inventor: Lawrence Vita, Ft. Lauderdale, Fla.

[73] Assignee: Vita Auto Stack, Inc., Ft. Lauerdale, Fla.

[21] Appl. No.: 08/903,105

[22] Filed: Jul. 30, 1997

[51] Int. Cl.[6] ..... E04H 6/12

[52] U.S. Cl. ..... 414/254; 414/256; 414/263; 414/800

[58] Field of Search ..... 414/253–256, 414/263, 282, 800, 231

[56] References Cited

U.S. PATENT DOCUMENTS

| | | | |
|---|---|---|---|
| 1,782,671 | 11/1930 | Allred, Jr. | 414/263 |
| 2,647,647 | 8/1953 | Alimanestiano | 414/254 |
| 2,838,186 | 6/1958 | Alimanestiano | 414/254 |
| 3,185,320 | 5/1965 | Chasar et al. | 414/282 |
| 3,497,087 | 2/1970 | Vita . | |
| 3,664,523 | 5/1972 | Hagel . | |
| 3,737,057 | 6/1973 | Neumann et al. | 414/231 |
| 4,005,785 | 2/1977 | Manaugh | 414/231 |
| 4,039,089 | 8/1977 | Kochanneck . | |
| 4,074,120 | 2/1978 | Allred et al. | 414/231 X |
| 4,108,322 | 8/1978 | Kochanneck . | |
| 4,264,257 | 4/1981 | Saurwein | 214/259 |
| 4,265,581 | 5/1981 | Ives et al. | 414/228 |
| 4,413,942 | 11/1983 | Roth et al. | 414/253 |
| 4,594,044 | 6/1986 | Soot | 414/263 |
| 4,976,580 | 12/1990 | Knakrick | 414/254 |
| 4,998,856 | 3/1991 | La Barre | 414/240 |
| 5,024,571 | 6/1991 | Shahar et al. | 414/231 |
| 5,238,348 | 8/1993 | Reimer | 414/254 |
| 5,409,342 | 4/1995 | Galli | 414/282 X |
| 5,456,562 | 10/1995 | Schlecker et al. | 414/256 X |
| 5,478,182 | 12/1995 | Hildebrand et al. | 414/261 |
| 5,580,206 | 12/1996 | Redelman et al. | 414/282 |
| 5,829,941 | 11/1998 | Zamorano Morfin | 414/254 X |

FOREIGN PATENT DOCUMENTS

| | | | |
|---|---|---|---|
| 4131409 | 3/1992 | Germany | 414/254 |

*Primary Examiner*—David A. Bucci
*Attorney, Agent, or Firm*—Quarles & Brady LLP

[57] ABSTRACT

An improved automated parking garage structure comprising a supporting framework bearing a plurality of vehicle parking stalls arranged in a radial manner on a plurality of levels about a central core. Each of the stalls support a vehicle on a series of fingers. An elevator tower is located within said central core and has an elevator platform adapted for vertical travel, the tower rotating about a vertical axis. A transfer lift for transferring a vehicle between ground level and a level for transfer to or from said elevator platform; is located at ground level and accepts vehicles for parking and return. The elevator platform includes an extension carriage for transferring a vehicle between the platform and the stalls and transfer lift. Operation of the transfer lift, elevator and tower are coordinated by an automated control system, which may include a first unit located at the tower and a second unit, serving as a customer interface, at a remote location. The two units are preferably coupled together by a wireless communication link.

20 Claims, 12 Drawing Sheets

VEHICLE PARKING STRUCTURE

The present invention relates to a vehicle parking apparatus.

BACKGROUND OF THE INVENTION

As a result of the increasing scarcity of land space, and increasing costs of labor, it is becoming more and more difficult to provide parking spaces and facilities, particularly in urban areas. In the present inventor's U.S. Pat. No. 3,497,087 of Feb. 24, 1970, there is disclosed an innovative parking system utilizing a circular tiered construction having a radial parking configuration for vehicles, in which the vehicle stalls are arranged circumferentially about an inner elevator structure. Such a general system contemplated significant economies in both site utilization and operation.

The present invention is an improvement to the invention, and further refines and modifies the general concepts disclosed therein. The features and benefits of such an improved parking structure include efficiencies in vehicle positioning and entry/exit from the structure, automated location identification and vehicle loading and retrieval, improved stability of the structure and improved safety.

SUMMARY OF THE INVENTION

The vehicle parking structure of the present invention comprises a multi-storied, circular parking structure having a plurality of radially-oriented parking stalls. An elevator tower structure is located within the interior of the parking structure and includes a lift apparatus to raise and lower an elevator platform therein between a position for vehicle entry or exit and a chosen one of a plurality of positions, adjacent a parking stall, for transfer of a vehicle to and from the parking stall. The elevator tower rotates upon a circular track. Simultaneous rotation and elevator lift actions provide for rapid vehicle transit.

A transfer lift provides an interface between the elevator and an entrance to and an exit from the parking structure. In a lowered position, the lift provides a stable platform upon which a car to be parked is driven and its occupants exit. For security purposes, the vehicle engine is turned off, its ignition key removed, and the doors locked. With the vehicle unoccupied, the lift rises to an elevated position, orienting the vehicle for transfer to the elevator and subsequent placement in a stall. Alternatively, the vehicle may be initially parked on a ground-level horizontally-reciprocating platform, which delivers the vehicle to the transfer lift in the parking structure. Such a system fully isolates the vehicle occupants from the parking structure. A second platform and transfer lift may be employed for vehicle return and exiting purposes.

The elevator platform is of a construction which includes a vehicle-receiving carriage which can extend outwardly beyond the elevator tower to receive a vehicle on the transfer lift, return to a retracted position fully within the elevator tower to allow the elevator carriage to be oriented adjacent a parking stall, and subsequently extend outwardly to deposit the vehicle in the stall.

Both the transfer lift and the parking stalls are formed with vehicle-support configurations which allow the elevator platform to mate therewith to effect vehicle transfer through a short-length vertical translation of the carriage.

Operation of the parking system may be fully automated, with microprocessor control of vehicle receipt, positioning in a chosen stall, and retrieval. Connection between the elevator control system and a remote customer interface, where payment, parking receipt and vehicle identification for retrieval are performed, may be by wireless communication, allowing for complete automated communication therebetween without the necessity for hard wiring.

BRIEF DESCRIPTION OF THE DRAWINGS

A fuller understanding of the present invention and the features and benefits thereof will be accomplished upon review of the following detailed description of a preferred, but nonetheless illustrative embodiment of the invention, when reviewed in association with the annexed drawings in which.

DETAILED DESCRIPTION OF THE INVENTION

Figure 1:
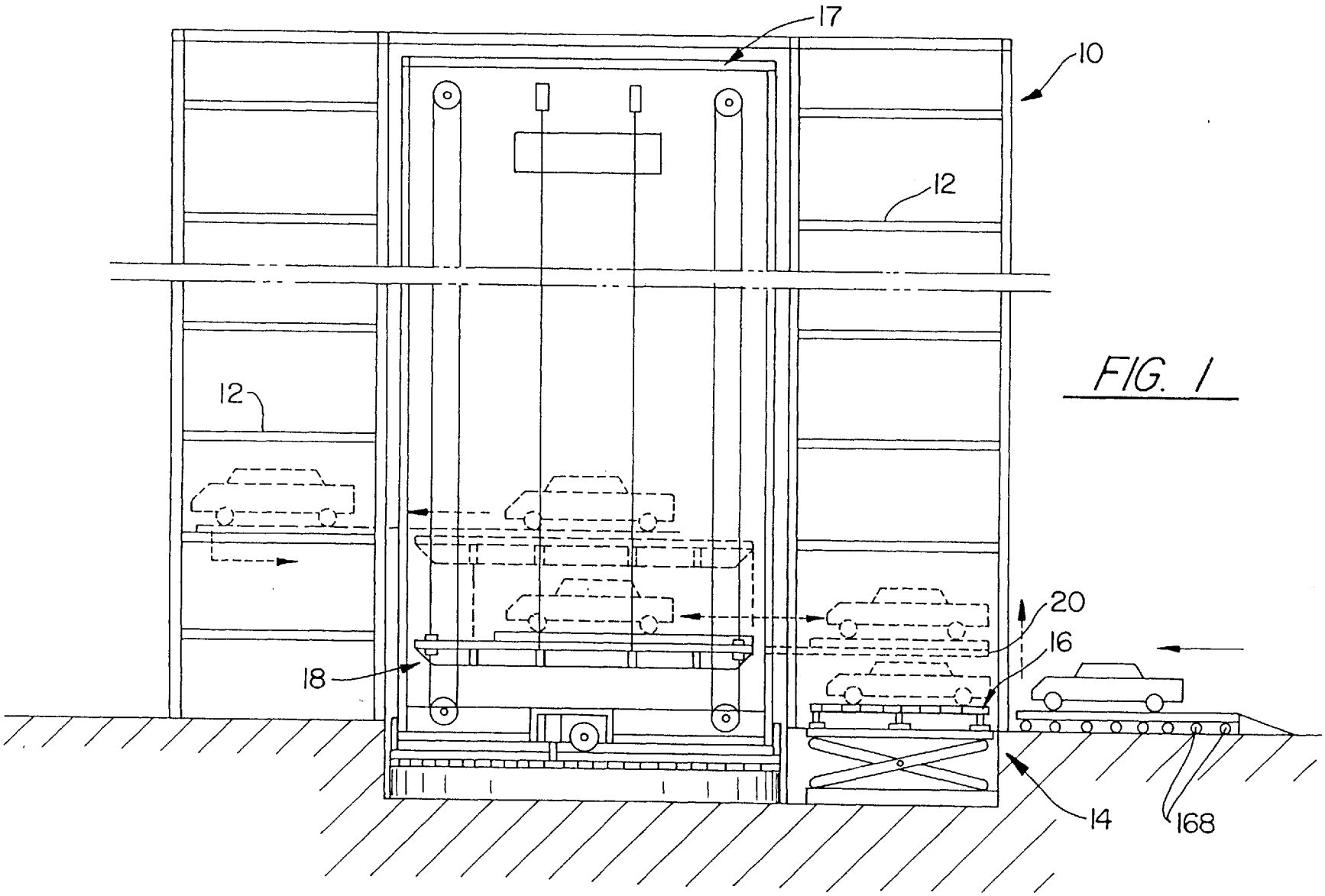
FIG. 1 is a sectional schematicized view of an improved vehicle parking structure in accordance with the present invention.
Figure 2:
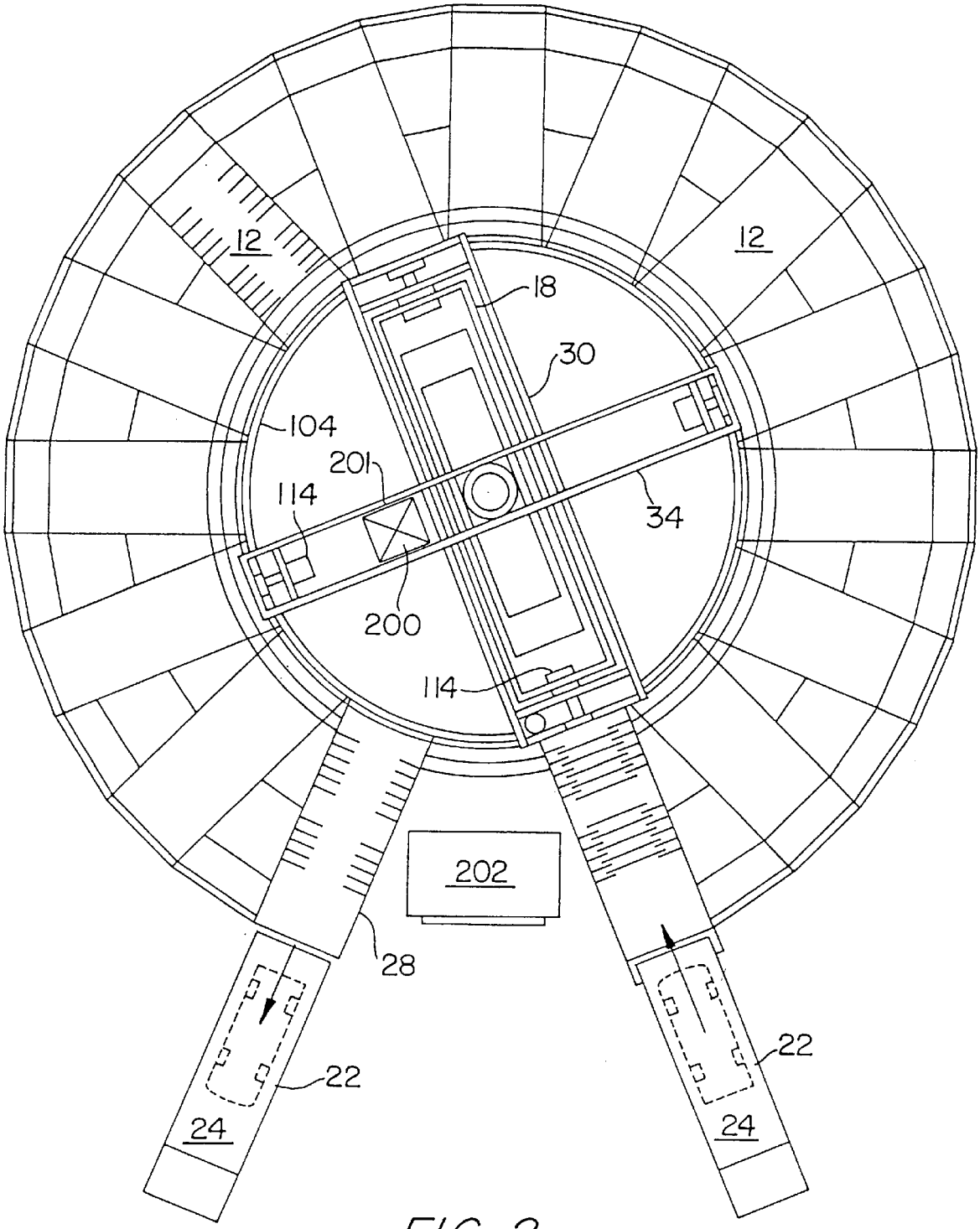
FIG. 2 is a schematic top plan view thereof.

With initial reference to FIGS. 1 and 2, a parking structure 10 in accordance with the present invention may preferably be composed as a multi-story frame structure, each of the stories having the capacity to store a plurality of vehicles in a radial manner in a corresponding plurality of parking stalls or locations 12. While FIG. 1 depicts a structure having six parking levels, it is to be appreciated that the number of levels may be varied without departing from the spirit or scope of the invention. The vehicles are shuttled to and from the parking stalls by central elevator platform 18, which is capable of rotation about a vertical axis as well as vertical motion. The elevator platform includes a telescoping carriage which extends to transfer a vehicle between the elevator platform and a stall, as well as between the elevator and a loading/unloading facility.

Vehicles to be parked are positioned on a loading facility comprising vehicle transfer lift apparatus 14 having a two-part vehicle support surface 16. After the driver and passengers alight from the vehicle, the vehicle lift apparatus extends to the raised position, as shown in phantom in FIG. 1, at which time the carriage of elevator platform 18, which is positioned adjacent the raised position of the lift, extends into a vehicle-receiving position directly below the raised support surface portion 20. The vehicle transfer lift apparatus then withdraws to the down position, the vehicle being supported upon the extended elevator carriage. The elevator carriage is retracted, bringing the vehicle into a central position within the elevator tower as depicted in FIG. 1. The elevator lift is then activated, raising the elevator to the level at which a designated empty stall is available while the tower is simultaneously rotating about a central axis to radially align the elevator platform with the available stall. The elevator carriage supporting the vehicle then extends, positioning the vehicle directly and slightly above the floor of the chosen stall. The elevator platform then descends slightly, transferring the support of the vehicle to the stall floor. The carriage then retracts. The elevator platform can then be rotated and raised or lowered as required for a subsequent operation.

Vehicle withdrawal is performed by an analogous process. In response to an appropriate command, which may, for example, be as the result of a patron inserting an encoded parking ticket into an appropriate validating device, the elevator platform both rises and rotates to be oriented adjacent, and slightly below the floor of the stall of the vehicle to be retrieved. The elevator carriage extends to underlie the stall floor. The elevator platform then rises slightly to engage the wheels of the vehicle and lift the vehicle from contact with the stall floor. The carriage retracts into the tower, and then descends to the transfer level in alignment with the exit transfer lift apparatus. The elevator carriage again extends and the transfer lift apparatus rises to meet the carriage, removing and raising it slightly from the extended carriage. The carriage then retracts, the transfer lift apparatus returning the vehicle to ground level at which time the operator and other occupants may enter the vehicle and drive it off the lift apparatus and away from the garage.

In order to isolate the driver and occupants of the vehicle from the parking structure, a horizontal shuttle platform system may be employed to convey vehicles to and from the transfer lifts. Shuttle system 22 includes a shuttle platform 24, typically level with an entrance road, upon which a vehicle to be parked is driven. The operator and occupants exit and lock the vehicle, which is then shuttled horizontally to a position directly above the retracted transfer lift within the parking structure, at which point the transfer lift engages the vehicle, removing it from the shuttle and raising it to the elevator reception level. The shuttle then returns to the starting position. A similar shuttle system 26 may be employed with a second transfer lift 28 for vehicle return.

Because the transfer lift raises vehicles from ground level to a first level for receipt by the main elevator platform, the parking structure 10 does not require significant site excavation, the structure being able to be constructed quickly and efficiently on land which is simply graded to level. This may be of significant benefit in areas where the water table is high and excavation requires water control provisions. Configured in the nature of a materials handling system, the structure can be efficiently built and operated.

Figure 3:
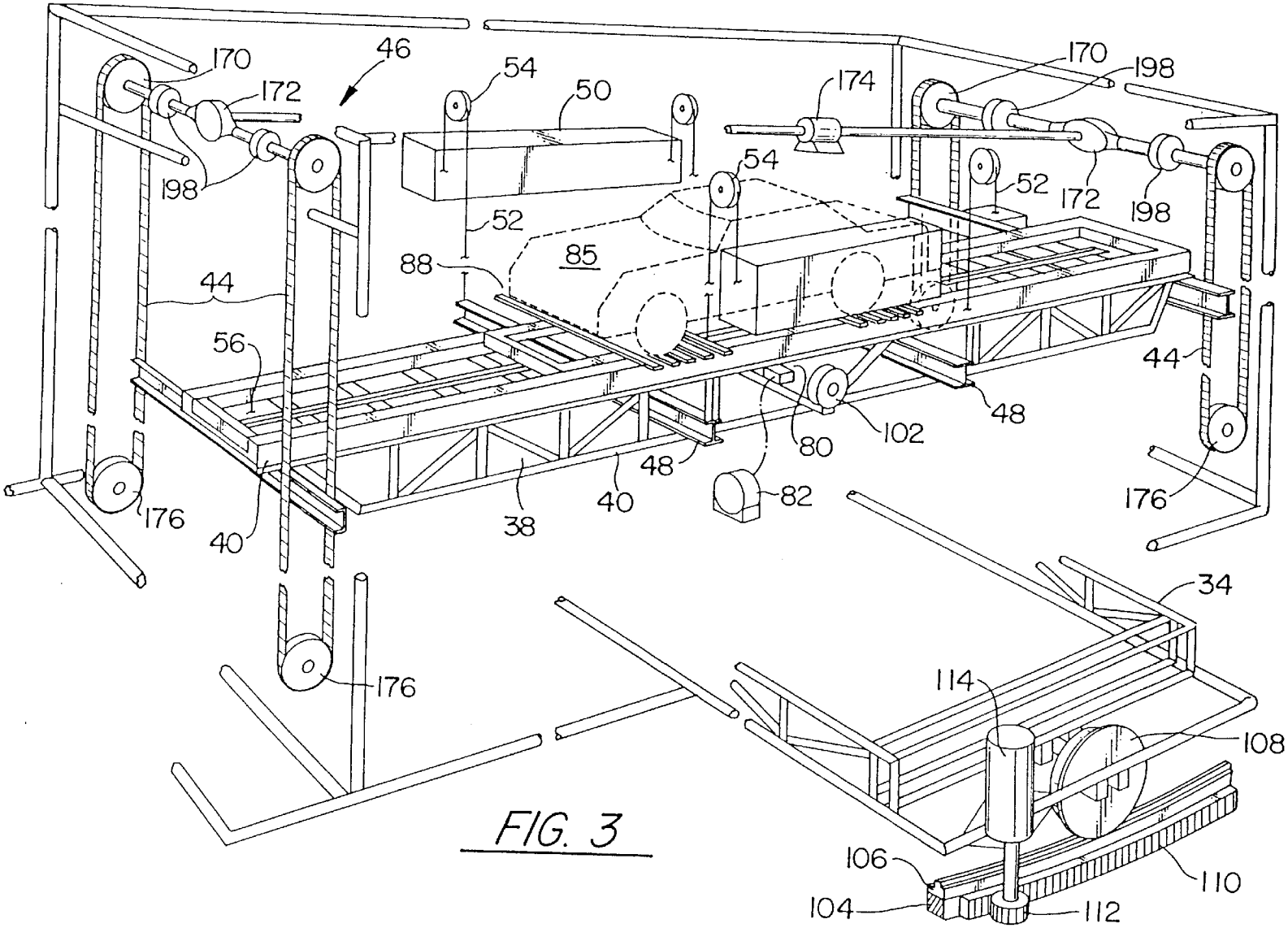
FIG. 3 is a detailed depiction of the vehicle elevator portion of the invention.

As perhaps best seen in FIGS. 2 and 3, the elevator system of the present invention includes elevator platform 18, located and supported for transit within elevator tower 17 which is mounted for rotation within the core of the generally cylindrical stall structure. As will be discussed in greater detail infra, the elevator tower may include an outrigger structure 34 to provide stability and further support for the tower.

Figure 8:
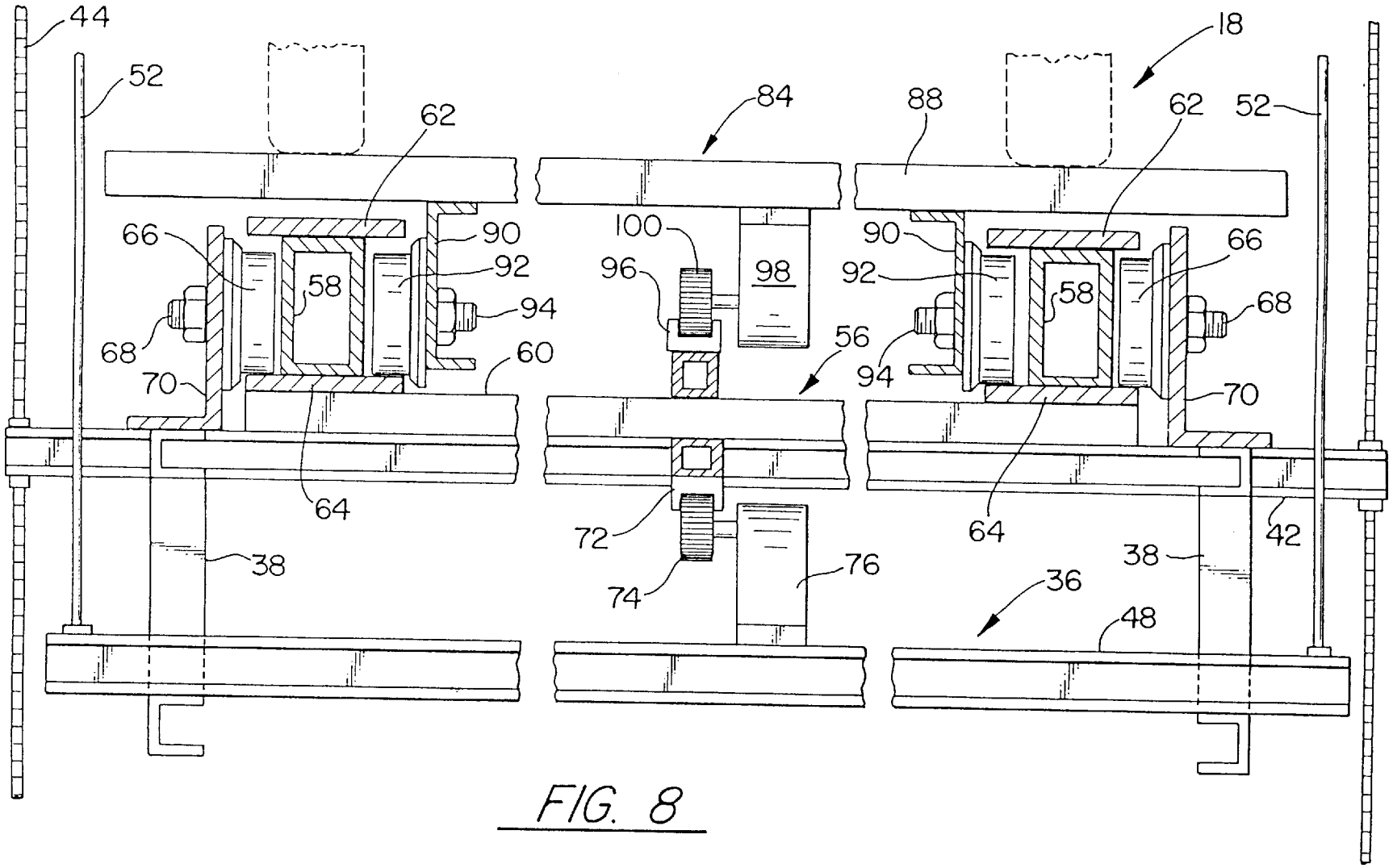
FIG. 8 is a detailed view in section taken along line 8—8 of FIG. 7 depicting the elevator platform.

FIGS. 3 and 8 further detail the elevator platform assembly. As shown therein, the platform may preferably comprise main platform frame 36, of a general truss-like construction, on which sits a two-part extension carriage assembly for retrieving vehicles from both the transfer lift apparatus and parking stalls and for delivering vehicles thereto. Main platform 36 may be formed with a plurality of truss-forming elements 38 supporting main beams 40. Transverse beams 42 are each fixed at their ends to pairs of chain loops 44 which, in conjunction with elevator drive apparatus 46, located at the top of the elevator tower, allows the elevator platform to be raised and lowered as required. A set of counterweights 50 are connected to the platform by cables 52 which run over pulleys 54, similarly located at the top of the tower, and which terminate at platform beams 48. The counterweights are chosen to balance the weight of elevator platform, as known in the art, to minimize the effective lifting load for the drive apparatus 46. The elevator platform frame 36 supports an extension carriage assembly comprising first and second extension carriages.

First extension carriage 56 is of generally rectangular construction in plan and is of a length substantially equal to that of the platform frame 36. It includes main lateral box beams 58 as seen in FIG. 8 joined by transverse members 60. Upper and lower track plates 62, 64, respectively, are affixed to the box beams. A series of first rollers 66 are mounted on axle studs 68 on the angle irons 70 of the main platform, and are embraced by the track plates 62, 64 extending outwardly from a first side of the first extension carriage's box beams 58. The combination of the plates 62, 64 and the rollers 66 allow the first extension carriage to extend outwardly from the platform frame in a cantilever-type fashion.

Extension/retraction drive for the first extension carriage is provided by a gear track 72 mounted to the underside of, and which extends the length of, the first extension carriage, and which is engaged by a pinion drive gear 74 operated by reversible motor 76 mounted to the platform frame 36. Power for the motor is provided by a cable (not shown) which runs from a junction box 80 on the platform frame (see FIG. 3) to a main power feed unit 82 located at the bottom of the elevator tower. As known in the art, feed unit 82 may include a cable take-up assembly to allow feed of the cable as the elevator platform rises, and take-up of the cable onto a drum as required as the elevator descends.

Second carriage 84 carries a vehicle 86, and is adapted to shuttle the length of the first extension carriage, allowing the receipt of a vehicle from either a parking stall or the vehicle lift apparatus, the return of a vehicle thereto, as well as centrally positioning the vehicle on the elevator platform during elevator operation. The second carriage includes a plurality of transverse bars 88 positioned and spaced to both support the wheels of the vehicle 86, and to interdigitate with both the parking stall floor elements and the upper portion 20 of support surface 16 of the transfer lift apparatus, as will be further discussed infra. The bars 88 form a frame with, and are affixed to, lateral rails 90.

To permit the shuttle operation of the second carriage, a series of second rollers 92 are mounted to the lateral rails 90 through axle studs 94, and similarly ride upon and between the track plates 62, 64 on a second side of the box beams 58 of the first extension carriage. A second gear track 96 is mounted to the top of first extension carriage and extends along the length thereof. Top carriage reversible drive motor 98 is mounted to the second carriage, and has pinion drive gear 100 which engages with the second gear track 96 to drive the second carriage along the length of the first carriage. A power cable (not shown) connects the drive motor to feed/take-up unit 102 (see FIG. 3) on the elevator platform frame 36. The feed/take-up assembly is in turn coupled to junction box 80.

As depicted in FIGS. 2 and 3, both the main tower and the outrigger 34 ride upon circular track 104 which is rigidly installed at or slightly below ground level, within the inner circumference of the surrounding parking stall structure 32. The track 104 includes a rail 106 upon which the wheels 108, affixed both to the main tower frame and outrigger, ride. A circular gear track 110 is associated with the rail 106, and is engaged by a pinion gear 112 associated with an individual drive motor 114 located proximate a wheel. The wheels, which may be four in number, may each be provided with an associated drive moter and gear.

Figure 9:
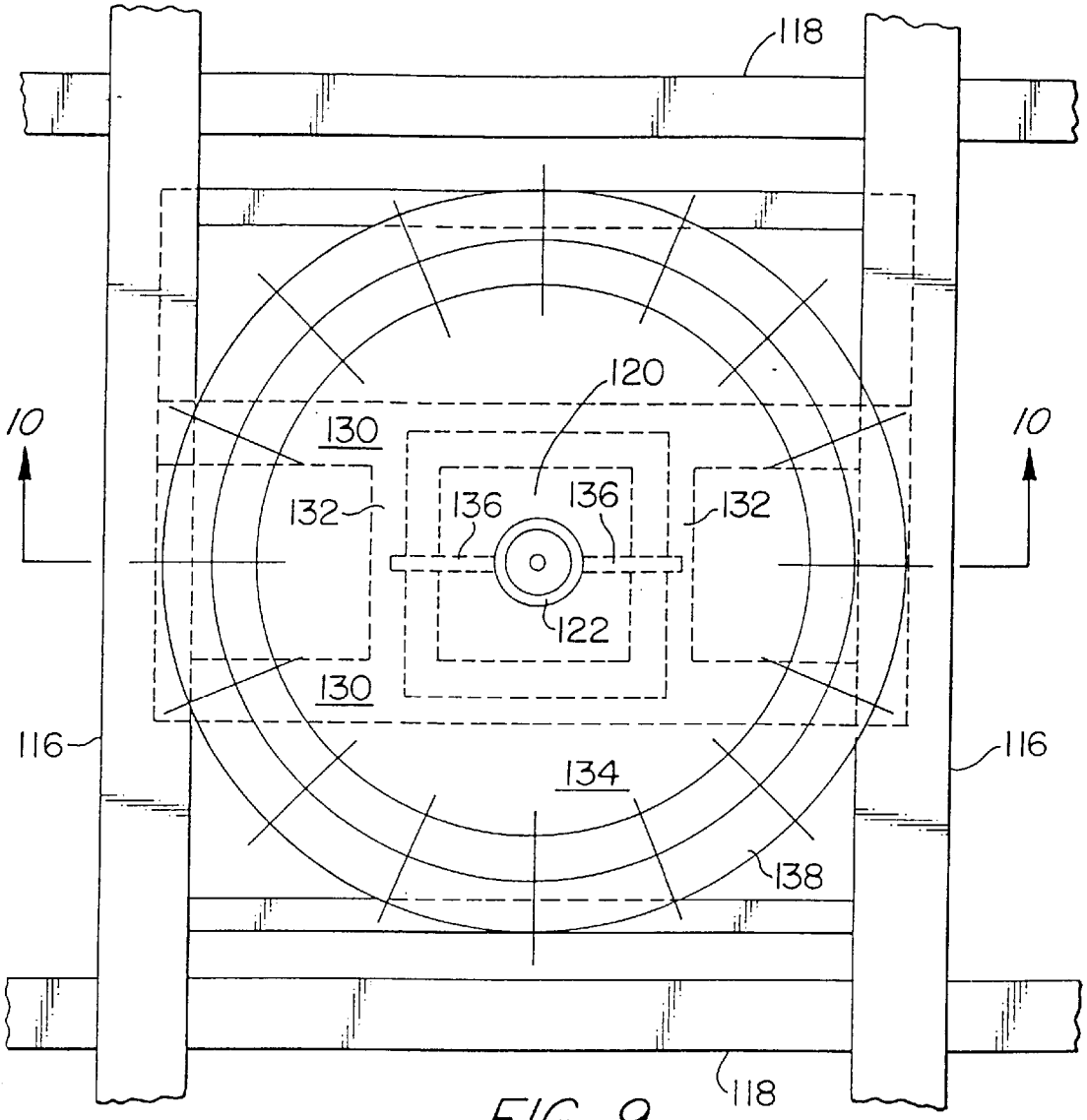
FIG. 9 is a top plan view of the elevator turntable.
Figure 10:
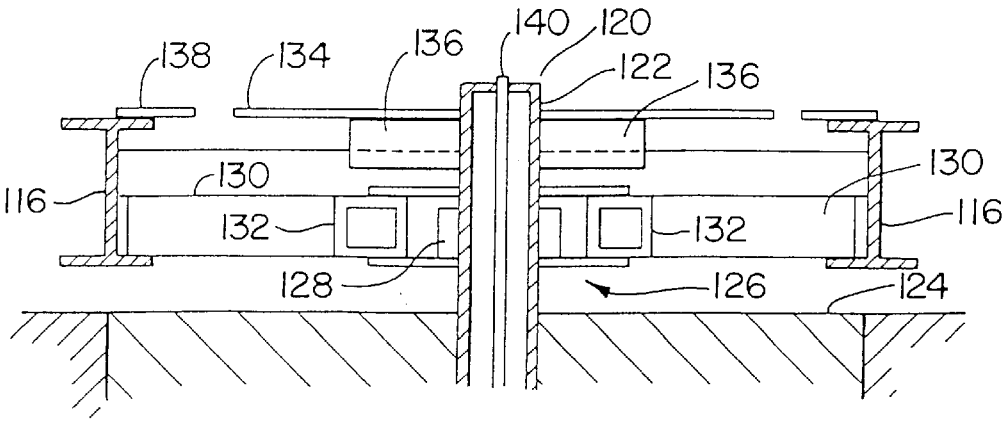
FIG. 10 is a plan view in section taken along line 10—10 of FIG. 9.

While the wheels and rail provide primary support and guidance for the elevator tower, additional stability is provided by a central mount as depicted in FIGS. 9 and 10. As shown therein, lower structural beams 116 for the tower, and beams 118 for the outrigger, are centrally joined together into a box-like construction encircling central axis 120 about which the tower rotates. The axis is defined by a rigid pipe section 122 vertically mounted into a concrete base 124. Located within the box-like structure formed by the tower and outrigger beams is bearing structure 126, which supports roller bearings 128 against the pipe and assist in maintaining the elevator tower in proper orientation with respect thereto. The bearing structure may include a pair of parallel-spaced beams between the tower beams 116 and spaced cross-members 132 surrounding the pipe 122 and supporting the roller bearings 128. A circular top plate 134 is mounted to the pipe 122 by gussets 136, and overlies and covers the central box structure plate and roller bearings. A concentric rotating ring plate 138 may be mounted to the tower and outrigger beams. A power cable 140 may be passed through the pipe 122 to power mains to provide power to the tower. An appropriate connection (not shown), including a commutator, as known in the art, may be employed to couple the fixed cable to the rotating tower.

It is contemplated that the tower and elevator, as well as the entire parking structure be constructed as a material-handling system, using prefabricated elements and subassemblies capable of being bolted or otherwise assembled without the necessity for welding or other expensive construction methods. Initial construction of the tower and elevator, which is free-standing with respect to the surrounding stall structure, can be utilized to house the parking stall structure in an efficient manner.

Figure 4:
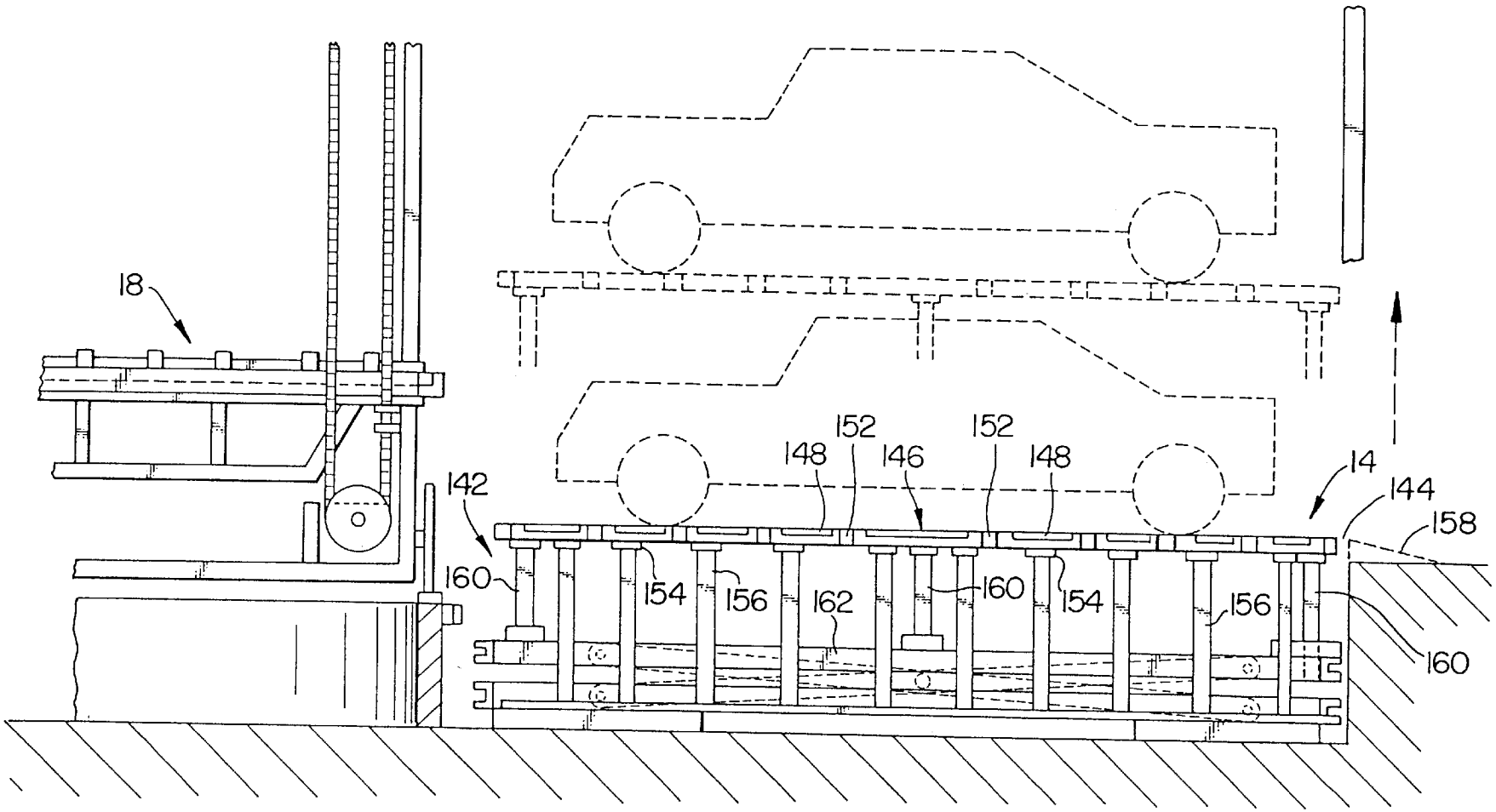
FIG. 4 is a depiction of the vehicle transfer lift oriented in the lowered position, with the raised position being depicted in phantom.
Figure 5:
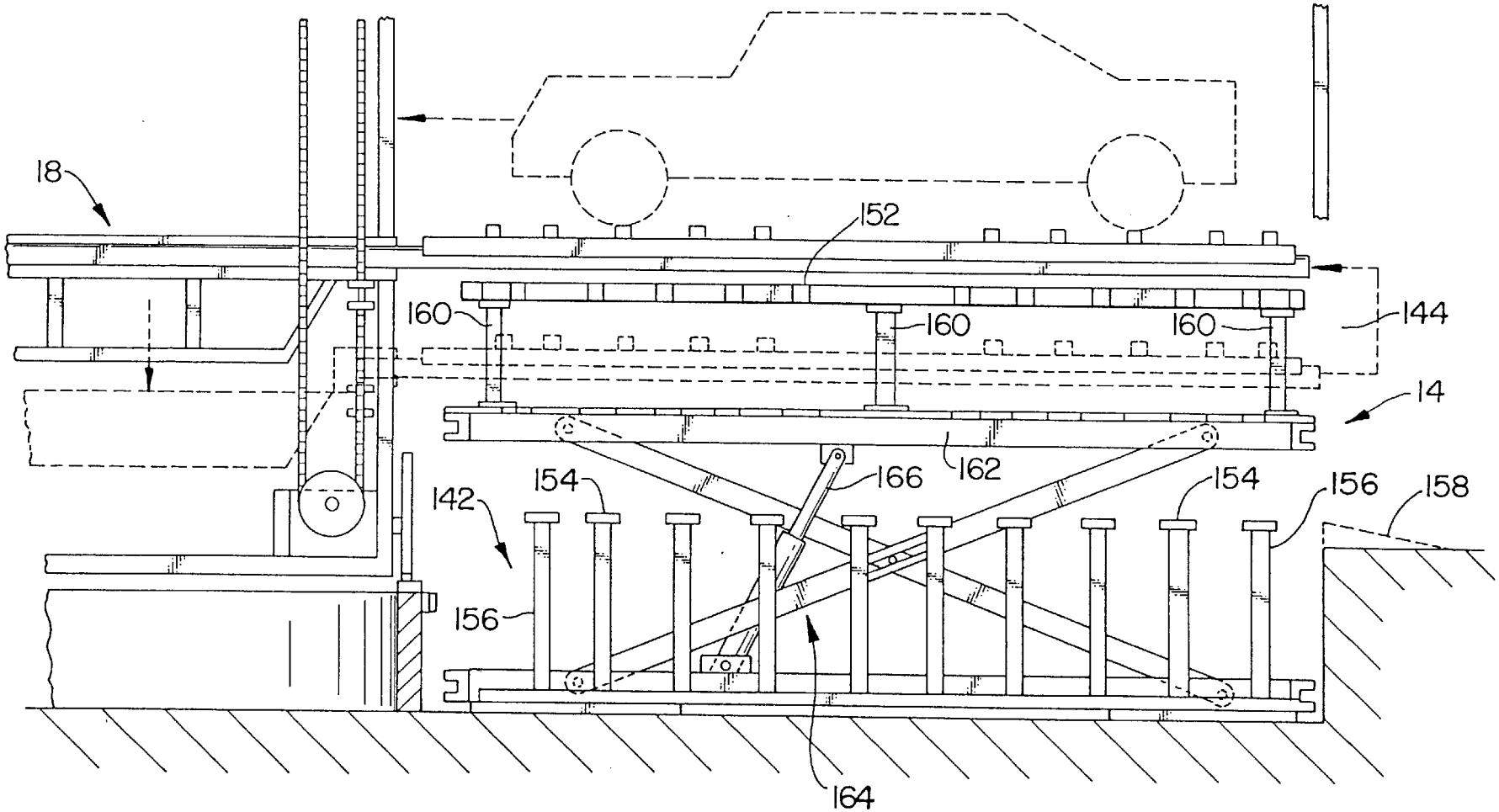
FIG. 5 is a depiction of the vehicle transfer lift in the raised position with the transfer carriage of the elevator being extended to mate therewith.
Figure 12:
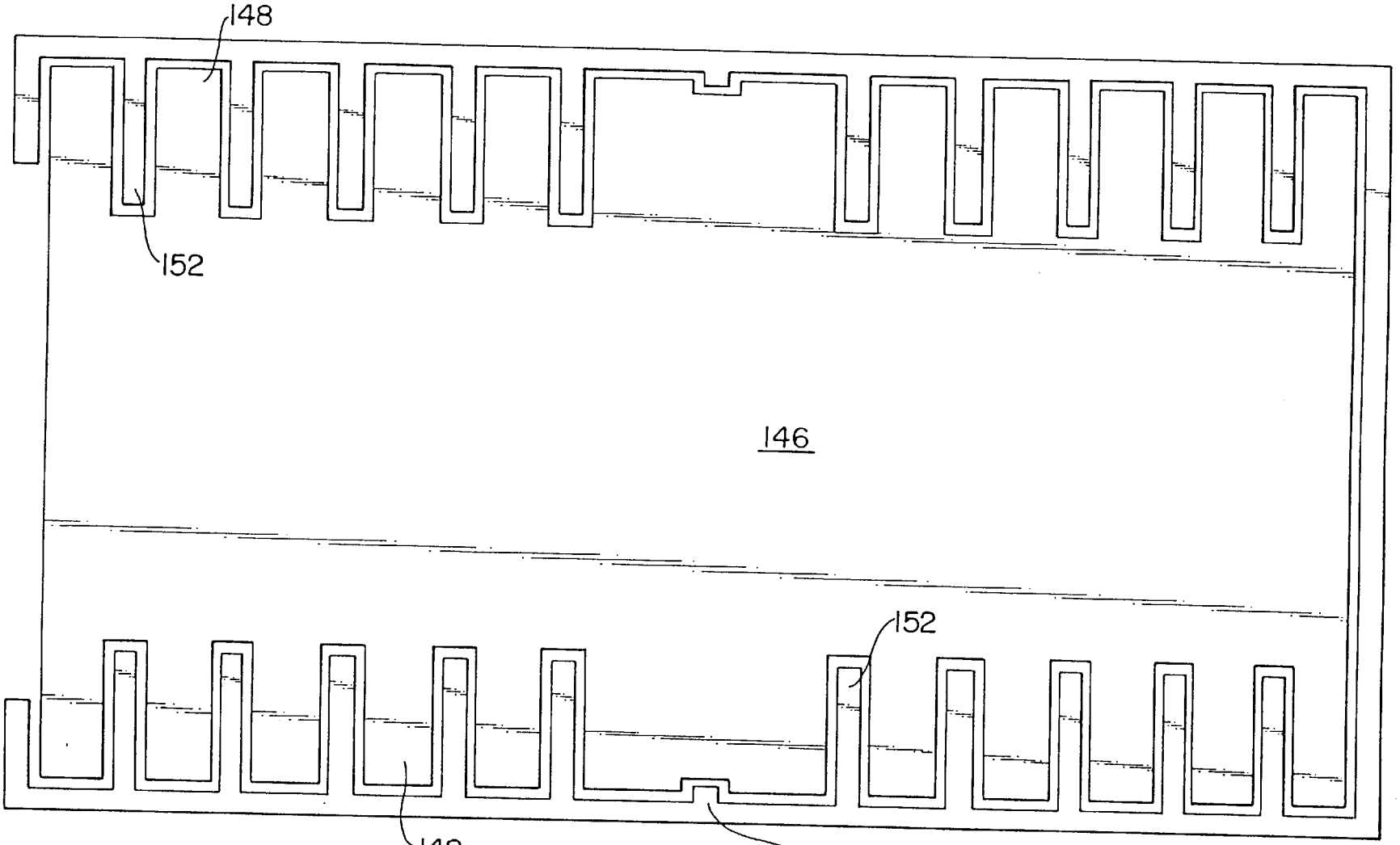
FIG. 12 is a top plan view of the platform of the external vehicle lift unit.

To avoid extensive excavation and to provide an efficient means for transfer of vehicles to and from the elevator, the transfer lift apparatus 14, as detailed in FIGS. 4, 5, and 12, is an integral part of the parking structure. As presented therein, the transfer lift comprises a fixed frame portion 142 and a lift platform 144 which traverses between a lowered position as shown in FIG. 4, permitting a vehicle to be driven or otherwise placed on the lift, and a raised position as shown in FIG. 5 in which the vehicle is transferred to or from the elevator platform 18.

With additional reference to FIG. 12, the lift platform 144 includes a main lift platform plate 146, generally rectangular in plan, and having dimensions appropriate for the receipt of a vehicle thereon. The lateral edges of the plate are provided with finger-like portions 148 located to correspond to and thus underlie the wheels of a vehicle driven onto the lift. Lift platform frame 150 surrounds the plate 146, its lateral edges having fingers 152 which interdigitate with the fingers of the main plate. When in alignment the main plate 146 and frame 150 form a continuous vehicle support surface.

As best in seen in FIGS. 4 and 5, main plate 146 is supported when the transfer lift is in the lowered position by a series of pads 154 which are mounted to the top ends of risers 156 of fixed frame 142. The fixed frame 142 is preferably located in a shallow pit or depression such that the pads 154 and thus the main plate 146 are in alignment with a vehicle-reception surface, which may include ramp 158, shown in phantom. The pads are preferably aligned to support the fingers 148 of the main plate.

The lift platform frame 150 is supported by risers 160 which in turn are mounted to a lower generally rectangular frame 162. Lower frame 162 is, in turn, supported by scissor lift assembly 164 and raised and lowered by hydraulic cylinder unit 166. In the lowered position, as depicted in FIG. 4, lift platform frame 150 is co-planar with the main plate 146, thus providing a composite surface aligned with the ramp 158, or other ingress-egress means for the transfer lift. To allow the lift platform to rise to the elevated position depicted in FIG. 5, the main plate 146 is lifted from the pads 154 by the lower frame 162, the main plate being carried by the lower frame until the lift platform is in the fully elevated position as shown in FIG. 5.

Because the transfer lift is located within the confines of the stall structure, it may be desired that a vehicle's occupants exit a vehicle to be parked, and enter a vehicle after return from the structure, remote from the stall structure. This may be accomplished by the inclusion of the shuttle 22 depicted in FIGS. 1 and 2 in lieu of the transfer lift ramp 158 depicted in FIGS. 4 and 5. As depicted, shuttle 22 may include a shuttle platform 24 exterior to the parking structure 10 which extends or cantilevers on rollers 168 or the like, in a manner known in the art, between an initial position as depicted in FIG. 1 and an extended position in which it overlies the lowered lift platform of transfer lift 142. Appropriate transfer mechanism may be applied, analogously to the method used to transfer the vehicle between the transfer lift, stalls, and elevator platform, to pass the vehicle to the transfer lift. A second shuttle may be employed in association with a second transfer lift to allow vehicle transfer during an exit procedure simultaneously with the transfer for stall loading.

Figure 11:
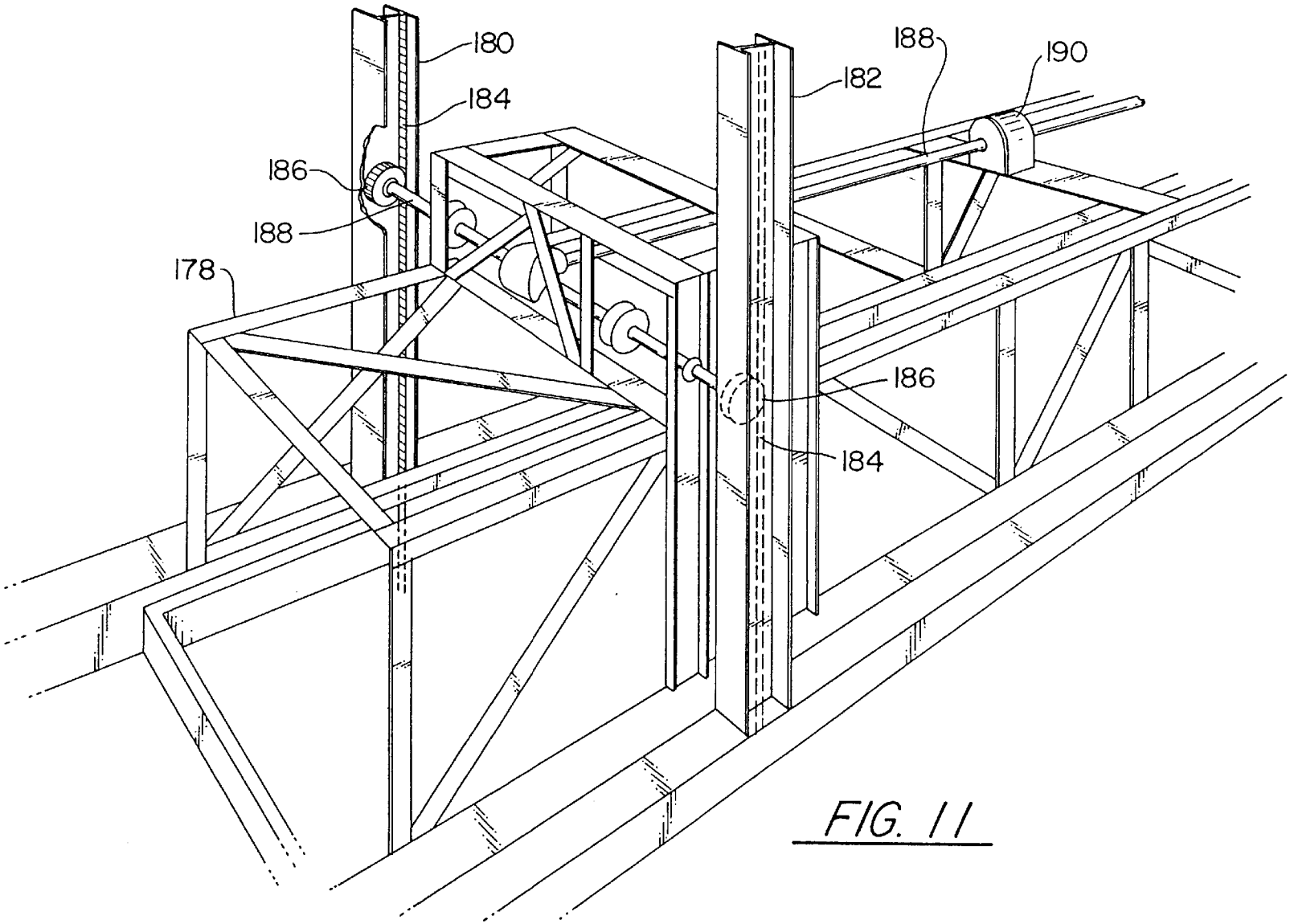
FIG. 11 is a representation of an alternative elevator lift mechanism.

As depicted in FIG. 3, the elevator platform is raised and lowered by engagement of the drive chain loops 44 about sprockets 170 coupled through transmissions 172 and brake units 198 to one or more drive motors 174. Lower idler sprockets 176, suitably journaled at the lower end of the tower, complete the drive chain loop. The drive sprockets, transmissions and motors are preferably mounted at the top of the elevator tower and are connected by appropriate cables along the tower for connection with the main feeder cable 140. Alternatively, and as depicted in FIG. 11, operation of the elevator platform may be controlled by a drive system mounted to the elevator platform itself. In such an embodiment, the platform may include a cage-like structure 178. The tower may include a pair of vertical beams 180, 182 extending upwardly the length of the tower. Gear tracks 184 extend the lengths thereof, and are engaged by pinion gears 186, coupled through transmission 188 to a motor 190. Depending on the nature of the motor employed, a second drive unit may be located at a second end of the cage. Power to the motor 190 may be provided by a cable from platform junction box 80.

Figure 13:
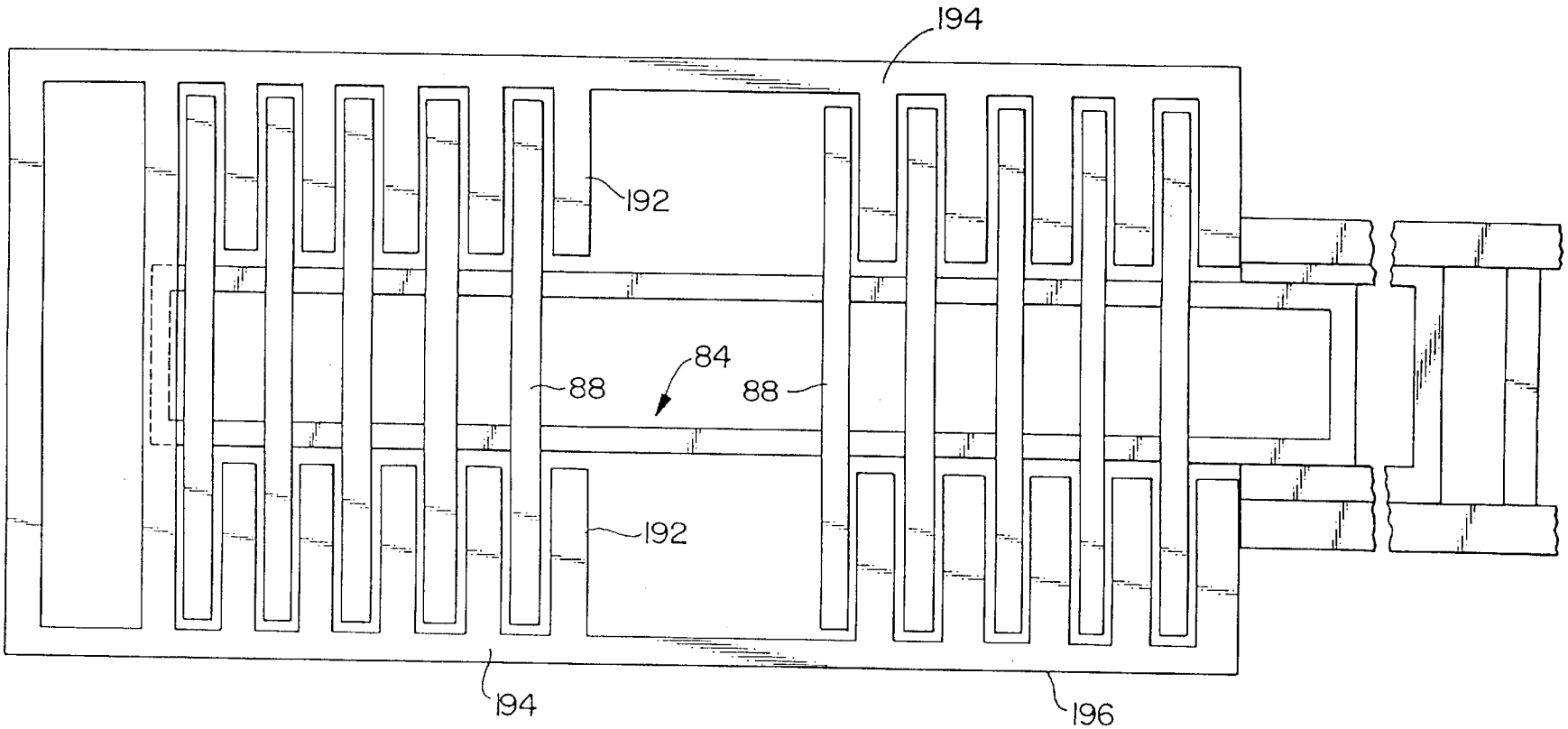
FIG. 13 is a top plan view of a parking stall with the elevator carriage extended into alignment therewith during a vehicle transfer process.

The stall structure surrounding the elevator tower may be of conventional frame construction, with or without walls. Walls are typically not required, as the parking stalls are filled and emptied automatically, without the presence of personnel within the structure. Each stall is constructed with a finger-like floor structure 196 as depicted in FIG. 13. The fingers 192 extend inwardly from stall sides 194, and are spaced and arranged to interdigitate with the transverse bars 88 of the second extension carriage 84 of the elevator platform. In order to provide sufficient support for the vehicle's wheels, and to minimize possible deformation to the tires as a result of an extended stay in a stall, the fingers 192 may preferably be formed with a flat upper surface on the order of 8 inches in width, spaced 6 inches apart. The elevator carriage bars 88 and the other associated vehicle-engagement elements are suitably dimensioned for compatibility with those dimensions.

Appropriate sensors are employed throughout the system to generate position location data. The sensors may be of the known proximity type, and may be located to provide height and angle (rotation) position for the elevator carriage, and for operational or confirmatory data for carriage extension and transfer lift elevation, as well as to confirm the presence of a vehicle in a stall or an elevator or transfer lift. This data is preferably utilized by a computerized system, typically under microprocessor 201 control, which generates the appropriate commands to the various drive motors in association with both the parking and retrieval of vehicles. The primary operational control signals are gathered and generated by a master control unit located in control room 200, which may be located on tower outrigger 34. When so located, the cables for the tower motor drive, as well as elevator platform operation are fed to the control room, power cable 140 passing through central pipe 122 powering the control room and thus the tower. Control room 200 may be preferably coupled to a remote control room 202 providing a customer interface. While control room 202 is depicted in FIG. 2 as being located within the parking structure, it may be located a distance therefrom, particularly when the shuttles 22 are employed, to keep patrons away from the structure.

Communication between the control room is preferably by radio, each control room being provided with an appropriate transceiver and modem, as known in the art, to allow data to pass therebetween. Control room 202 may include appropriate customer interface equipment, including a payment acceptance terminal, a parking ticket or receipt issuing facility, and a receipt reader or validator. Typically, the payment acceptance terminal would be configured to accept both cash and credit card payments. Alternatively, the remote control room may be manned by operating personnel.

Operation of the system is as follows. In the inactive state, the elevator platform may be in the lowered position, adjacent the transfer lift. The first extension carriage is centered on the elevator platform frame and the second extension carriage is at the end of first extension exterior carriage, adjacent the transfer lift (the "a" side). The transfer lift is in the lowered position.

A vehicle to be parked is driven onto the entrance shuttle 22 or, when a shuttle is not used, directly onto the transfer lift. The vehicle is shut off and locked, since manual intervention throughout the parking process is not required. The occupants of the car exit and proceed to the remote control room 202. Upon appropriate payment a parking receipt is generated. With generation of a receipt, a vacant parking stall is identified and its location referenced to the receipt. Such reference may be internal to the system and may be also encoded on the receipt. With receipt issue, the shuttle transfers the vehicle to the transfer lift. The transfer lift then rises to the position depicted in FIG. 5. The elevator platform 18 rises to the position shown in phantom, with the first and second carriages positioned slightly below the raised lift. Platform frame 150's fingers 152 have separated from the fingers of main plate 146, which is resting on lower frame 162. The extension carriages then extend from the elevator, the transverse bars 88 of the second extension carriage being positioned in an interdigitated alignment with the platform frame fingers 152. The elevator platform then rises slightly, the carriage subsequently retracting to bring the vehicle within the elevator. The elevator platform then rises and rotates into alignment with the designated stall. Simultaneously, the second carriage shuttles across the first carriage to the opposite ("b") side of the platform. The platform is oriented such that the "b" side is adjacent the chosen stall.

Figure 6:
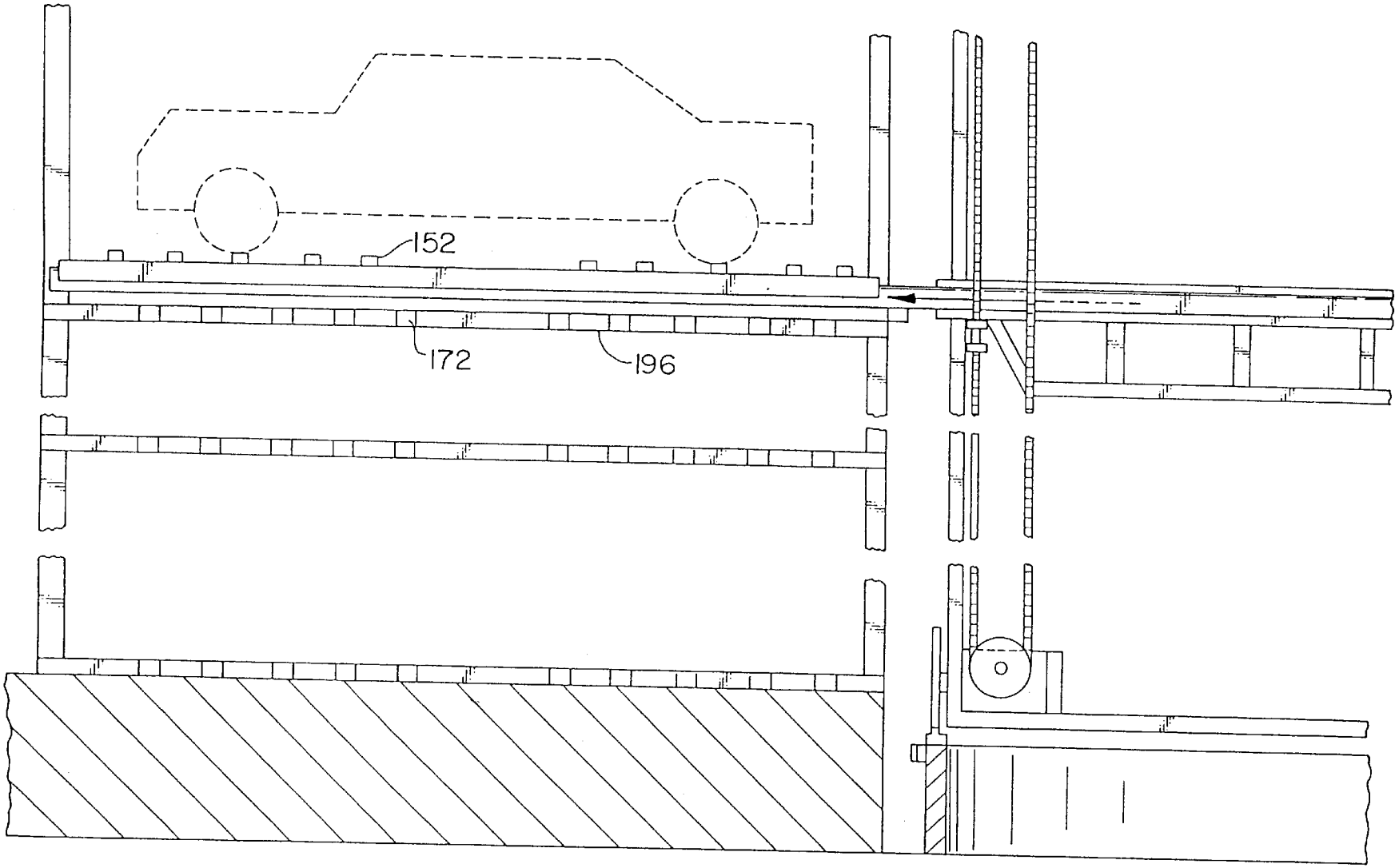
FIG. 6 is a depiction of the elevator in alignment with a parking stall in connection with the transfer of a vehicle to the stall.
Figure 7:
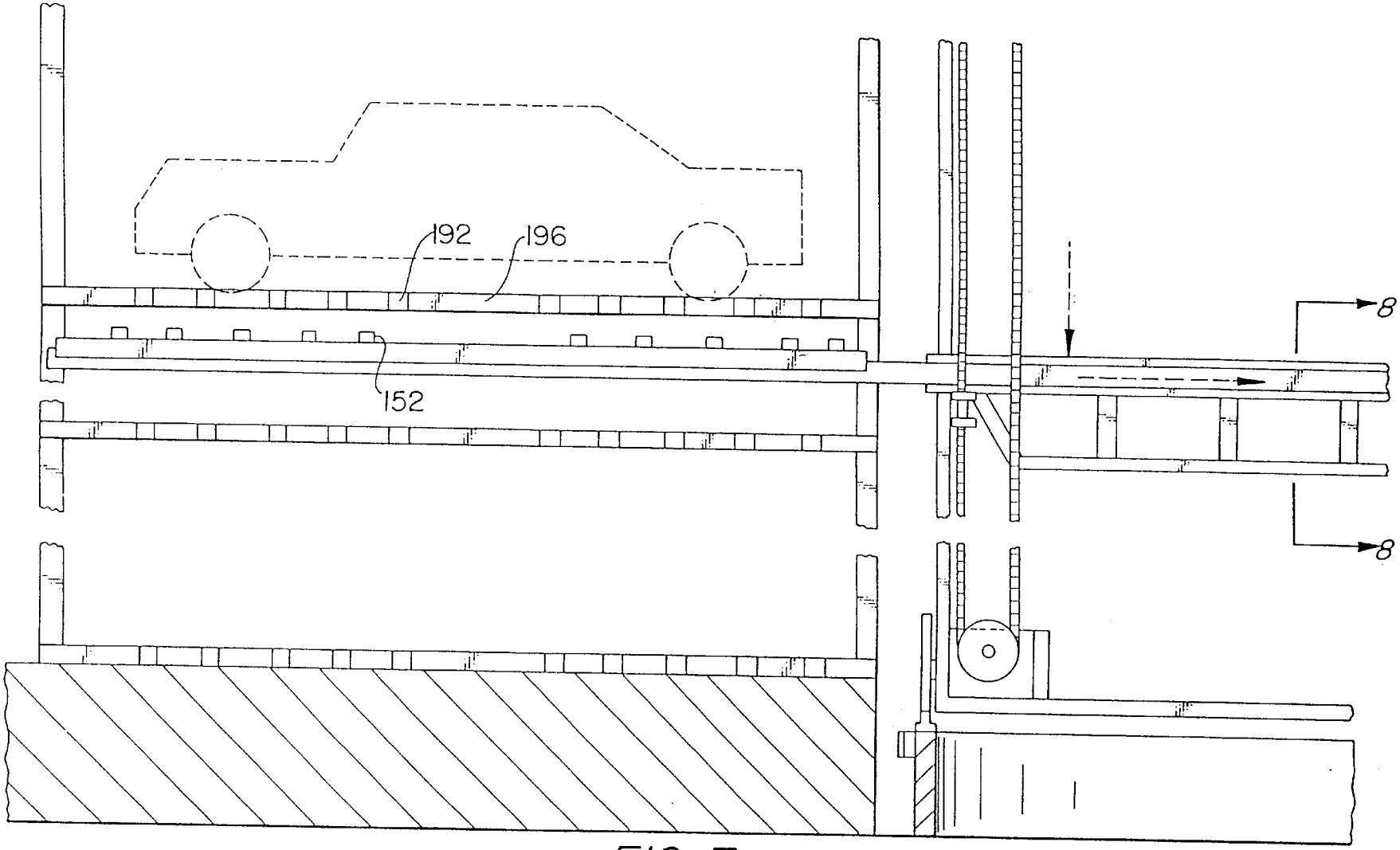
FIG. 7 depicts the deposit of a vehicle in a stall by the elevator.

The transfer of the vehicle to the stall is depicted in FIGS. 6 and 7. The elevator platform is initially oriented with the first and second carriages slightly above the stall floor 196, with the vehicle nose facing the stall, as the vehicle was passed from the "a" side to the "b" side of the platform. The carriages then extend as shown in FIG. 6, orienting the vehicle directly above the stall floor. The platform frame fingers 152 are oriented to interdigitate with the stall fingers 192. The elevator platform then descends to the lowered position depicted in FIG. 7, transferring the vehicle and depositing it upon the stall fingers. The carriages then retract into the tower, the elevator being positioned for a subsequent activity.

Recovery of a vehicle from a stall occurs with the presentation of a properly validated receipt to the remote control room apparatus. Upon confirmation of the validity of the receipt, and payment of additional fees, if required, the location of the vehicle associated with the receipt is identified, the computer system generating the appropriate lift and rotation commands to the elevator to position itself for vehicle recovery, including the positioning of the second carriage at the "b" end of the platform. The platform is positioned slightly below the stall floor, as shown in FIG. 7, and the carriages extend into proper alignment with the floor fingers. The elevator platform then rises to lift the vehicle from the stall and transfer it to the second carriage. The carriages then retract and the elevator platform returns to a position adjacent the exit transfer lift. During the return the second carriage does not pass to the "a" side of the platform, but rather stays at the "b" side, such that the nose of the vehicle remains oriented out, towards the receiving transfer lift. This allows the vehicle to be driven off in a normal, forward gear, rather than requiring it to be driven in reverse gear.

Deposit of the vehicle upon the exit transfer lift is performed by extending the elevator carriages slightly above the raised transfer lift and lowering the vehicle onto the platform frame fingers. The carriages are then retracted, and the transfer lift lowers, allowing the vehicle to be either driven off or conveyed by the exit shuttle to a location for receipt and drive-off by the owner.

Operating under computer control, an optimum path for elevator platform travel can be developed using techniques known in the art. Similarly, an inventory of available parking stalls can be maintained, allowing the shortest load/unload time to be utilized at any particular time and occupancy level. To insure proper operation redundant systems can be employed, and manual overrides provided.

It is to be recognized by those skilled in the art that variations, modifications and adaptations to the embodiments of the invention set forth herein may be accomplished without deviating from the intended scope of the invention. Accordingly, the invention is to be measured by the scope of the claims annexed hereto.

I claim:

1. An automated parking garage structure comprising:

a supporting framework bearing a plurality of vehicle parking stalls arranged on a plurality of levels, each of said stalls having means for the support of a vehicle therein;

an elevator tower having an elevator platform adapted for travel between said stalls on said plurality of levels;

a transfer lift for transferring a vehicle between ground level and a level for transfer to or from said elevator platform, said transfer lift having a composite vehicle support surface;

means for moving said elevator tower and elevator platform and means for raising and lowering said elevator platform within said tower; said elevator platform having an extension carriage for transferring a vehicle between said platform and said stalls and transfer lift; and, means for coordinating the operation of said transfer lift, said moving means, said raising and lowering means, and said extension carriage for transporting a vehicle placed on said transfer lift to a vacant parking stall in said structure and for retrieving a vehicle from a parking stall to said vehicle lift, said transfer lift comprises a fixed frame and a lift platform, said lift platform having a frame having a pair of opposed lateral edges bearing a spaced plurality of stub beams located and arranged to support the tires of a vehicle thereon, and a lift platform plate having lateral fingers interdigitating with said stub beams.

2. The parking garage structure of claim 1, wherein said transfer lift is located within said supporting framework.

3. The parking garage structure of claim 2, wherein said parking stalls are arranged in a radial manner and said moving means comprises a means for rotating the tower, said rotating means having a circular track within said core and a plurality of individually driven wheels mounted to said tower riding upon said track.

4. The parking garage structure of claim 3, wherein said tower includes an outrigger extending perpendicularly from a main to elevator shaft portion of the tower, said wheels being journaled to said outrigger and said main elevator shaft.

5. The parking garage structure of claim 4 further comprising a main rotational bearing between said tower and a central vertical axis, said axis comprising a fixed vertical shaft.

6. The parking garage structure of claim 1 further comprising a shuttle for conveying a vehicle from a ground location exterior of the supporting framework to said transfer lift.

7. The parking garage structure of claim 1, wherein said transfer lift platform further comprises a central plate having opposed lateral sides bearing slots therealong aligning with corresponding stub beams of said lift frame, said central plate and said lift frame being in planar alignment when said elevating platform is at a first lowered position and being separated, with said lift frame being above said central plate, when said elevating platform is at a second raised position.

8. The parking garage structure of claim 1, wherein said operation coordination means include a digital processor located in a housing mounted to said tower.

9. The parking garage structure of claim 8 further comprising an automated customer interface comprising payment acceptance means and a receipt generator and receiver.

10. The parking garage structure of claim 8, wherein said customer interface is located at a position remote from said housing.

11. The parking garage of claim 10, wherein said customer interface is operatively coupled to said operation coordination means by a wireless link.

12. The parking garage structure of claim 1, wherein said platform has a first end for orientation adjacent said transfer lift for transfer of a vehicle from said transfer lift to said platform and a second end for orientation adjacent said transfer lift for transfer of a vehicle from said platform to said transfer lift and for transfer of a vehicle between said platform and a parking stall.

13. The parking garage of claim 1, wherein said stalls each comprise a stall floor formed of a series of spaced plates each having a planar top surface for support of tires of a vehicle.

14. The parking garage structure of claim 1, wherein said extension carriage comprises a first carriage mounted for extension from a platform frame and a second carriage mounted for positioning along the length of said first extension carriage.

15. The automated parking garage structure of claim 3, wherein said means for raising and lowering said elevator platform comprises a motor drive located at a top of said tower coupled to said platform by a chain loop drive.

16. The automated parking garage structure of claim 15, wherein said motor drive includes a motor, a transmission and a brake.

17. The automated parking garage structure of claim 1, wherein said means for raising and lowering said elevator platform comprises a motor drive located on said platform, said motor drive including a drive gear mating with a gear track extending vertically along the tower.

18. A method for the automated parking of a vehicle in a parking structure and subsequent retrieval of said vehicle, comprising the steps of:

orienting said vehicle on a transfer lift;

raising said transfer lift to a position for vehicle transfer to a main elevator;

transferring said vehicle to said main elevator;

moving said elevator to a position adjacent a chosen vacant parking stall in the parking structure;

transferring said vehicle to said stall;

awaiting a command to retrieve the vehicle and thereupon moving said main elevator adjacent the chosen stall;

transferring said vehicle to the elevator;

moving said main elevator to a point for transfer of said vehicle to said transfer lift;

transferring said vehicle to the transfer lift, said transfer lift being in a raised position; and lowering said transfer lift to permit the vehicle to be driven away.

19. The method of claim 18 further comprising the steps of:

transferring the vehicle to the transfer lift by a shuttle from a remote location prior to raising the transfer lift; and, transferring the vehicle from the transfer lift by said shuttle to a remote location for driving away subsequent to lowering the transfer lift.

20. The method of claim 19, wherein:

said step of transferring the vehicle from the transfer lift to the main elevator is with a first end of the elevator located adjacent the transfer lift; and, said step of transferring the vehicle from the main elevator to the transfer lift is with a second end of the elevator located adjacent the transfer lift.

* * * * *